US005328425A

United States Patent [19]

Knighton et al.

[11] Patent Number: 5,328,425

[45] Date of Patent: Jul. 12, 1994

[54] MARTIAL ARTS STRIKE AND KICK BAG

[76] Inventors: Mark H. Knighton, 715 E. 3rd St., Mesa, Ariz. 85203; Mark M. Nuetzman, 1737 N. Old Colony, Mesa, Ariz. 85201

[21] Appl. No.: 768,027

[22] Filed: Sep. 30, 1991

[51] Int. Cl.[5] ..... A63B 69/20; A63B 69/24

[52] U.S. Cl. ..... 482/87; 482/86

[58] Field of Search ..... 273/55 A, 55 R; 482/86, 482/273, 482, 87, 90; 272/77, 76; D21/197

[56] References Cited

U.S. PATENT DOCUMENTS

| | | | |
|---|---|---|---|
| 1,267,678 | 5/1918 | McArdle | 482/89 |
| 1,544,693 | 7/1925 | Snyder | 273/55 A |
| 1,663,659 | 3/1928 | Hart et al. | 273/55 A |
| 1,685,495 | 9/1928 | Latz | 482/89 |
| 2,826,416 | 7/1955 | Heffner | 482/86 |
| 4,401,303 | 8/1983 | Anderson et al. | 482/83 |
| 4,491,315 | 1/1985 | Dye | 482/89 |
| 4,934,938 | 6/1990 | Orlandi et al. | 273/55 A |

FOREIGN PATENT DOCUMENTS

| | | | |
|---|---|---|---|
| 1409300 | 7/1988 | U.S.S.R. | 482/83 |

*Primary Examiner*—Richard J. Apley
*Assistant Examiner*—Jerome Donnelly
*Attorney, Agent, or Firm*—Gregory J. Nelson

[57] ABSTRACT

A martial arts kick and strike bag made up of cylindrical and conic sections. A cylindrical section will effectively receive blows delivered in a plane orthoginal to the axis of the practice bag. Blows delivered along a rising incline with respect to the axis of the bag will be most effectively received by the wall of the conic section. Blows are most effectively received when striking the wall of the bag at an impact angle of approximately 90°. The selected angles of the bag walls with respect to the axis of the bag minimize reaction forces such as might result from rising striking blows delivered to prior art, cylindrical, training bags.

2 Claims, 1 Drawing Sheet

MARTIAL ARTS STRIKE AND KICK BAG

BACKGROUND

1. Field of the Invention

The invention relates to martial arts training devices. In particular, the invention relates to body, punching bags to be struck and kicked by a person practicing a martial art. More specifically, the invention relates to a body, punching bag having its outer walls angled to present an aspect more in keeping with that of an actual opponent.

2. Prior Art

In practicing boxing, karate, and other forms of martial arts, persons frequently make use of large cylindrically shaped punching bags. These bags, about four feet in circumference, have a length usually greater than three feet and less than four feet. These bags have a longitudinal axis. The walls of the bag are parallel to this axis.

When a person practicing hooks and jabs to the head and shoulder region of the opponent strikes out at a body, punching bag, the person's hand travels generally in a plane which is perpendicular to the axis of the bag. The person's hand thus strikes the bag outer wall at an angle of approximately 90°. This is a desirable angle since the full impact of the blow is delivered from the hand to the bag. However, when a person, practicing with the bag, delivers a rising hook punch, or the like, the person's hand impacts the bag at a rising impact angle. Thus, the angle between the outer wall of the bag and the person's arm will be less than 90°. In this instance the full impact of the blow will not be delivered to the bag. Some force will be expended in deflecting the person's blow; and, reaction forces resulting from such deflection can produce injuries to the wrist, arm, or shoulder joints of the person striking the bag.

A similar result obtains when a person practices striking the bag by kicking it. A kick delivered to the cylindrical walls of the conventional body, punching bag frequently moves along an upwardly inclined angle with respect to the axis of the bag. Again, this means that the blow is delivered to the outer wall of the bag at an angle of less than 90°, causing the production of deflection forces. The reaction to these deflection forces may result in injury to the ankle, knee or hip joint of the person practicing the kick against the conventional body, punching bag.

It is the intention that the invention shall provide the means whereby a person practicing a martial art may deliver striking blows and kicks to the outer walls of a training bag such that the blows will be directed along a line generally orthoginal to the outer wall of the bag even when the blows are delivered along a rising incline to the axis of the bag.

SUMMARY OF THE INVENTION

The invention is a martial arts training bag suitable for striking by a person practicing a martial art. The bag comprises a first, cylindrical section; and a second, conical section, having its base coupled to said first section. There is also the second, conical section which has a truncated cone shape.

Alternatively, the invention is disclosed as a martial arts training bag having a plurality of sections, coupled one to another. Each of the sections is defined by an outer wall of the bag. There is a longitudinal axis common to each of the plurality of sections. A first one of the plurality of sections has an outer wall at a selected angle to 90° the axis for effectively receiving striking blows from a person's hand moving in a plane generally perpendicular to the axis.

A second one of the plurality of sections is coupled to the first and has an outer wall at a selected angle to the axis for receiving striking blows inclined, with less than respect to the axis, at an upwardly directed angle. Optionally, there is a third one of the sections which has an outer wall at a selected angle to the axis for receiving a striking 90° blow from a person's foot moving in a plane generally perpendicular to the axis.

Finally, the martial arts training bag is seen as comprising a first, cylindrical section representative generally of the head-and-shoulder's region of an opponent's body. A second, lower, downwardly tapering section 13, coupled to the first section, representative generally of the torso region of an opponent. And, a third, lower, cylindrical section, coupled to the second section, representative generally of the hip-to-knee region of an opponent. A longitudinal axis is shared in common by these first, second and third sections. Each of the various embodiments include suspension means coupled to the first section for suspending the bag in a position to be struck.

DESCRIPTION OF THE DRAWINGS

FIG. 1 illustrates a boxing opponent in a defensive stance. Lines adjacent to the boxer's figure emphasize the tapering aspect of the boxer's figure. A similar tapering aspect is presented by karate opponents, and the like.

A DETAILED DESCRIPTION OF THE INVENTION

Figure 1:
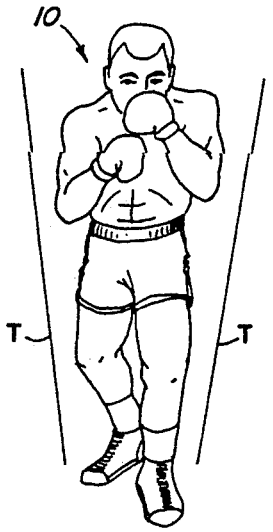

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

The drawing of FIG. 1 presents the frontal aspect of a boxer in a defensive position. Because of the raised arms and clenched fists, the breadth of that aspect is increased in the head and shoulders region of the boxer. The aspect then tapers down toward the waist and groin region and drops, generally cylindrically, to the feet. The tapering aspect presented by the boxer is emphasized by the paired sloping lines T in FIG. 1.

Figure 2:
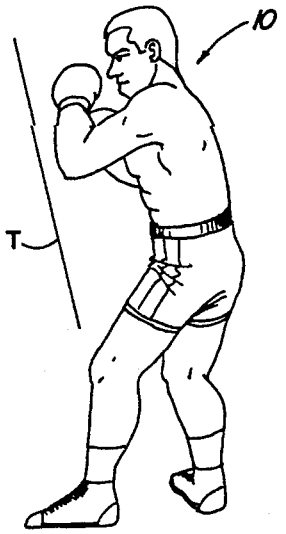
FIG. 2 is a side view of the boxer of FIG. 1 indicating the incline presented by head and torso when the boxer assumes a defensive position.

The sloping line T adjacent the side view of the boxer in FIG. 2 emphasizes the inclination of the torso of the boxer who has assumed the defensive position. Jabs and punches at such a boxer will generally strike the head, shoulders and upper chest with an impact angle of approximately 90°. However, to strike the lower regions of the chest and the abdomen region of the boxer a rising hook punch or kick would be required to impact at the preferred 90° angle.

Groin kicks and leg checks to the lowermost regions of the boxer will be effective when delivered in a plane generally parallel to the ground. The incline of the boxer's torso begins slightly above the groin region and thus the groin region is susceptible to kicks and striking blows delivered within a generally horizontal plane. Leg checks on an opponent are generally delivered by a foot traveling in a generally horizontal plane approaching the opponent's legs from the sides. A 90° impact with the leg is generally achieved thereby, even when the opponent has advanced one or the other of his legs. Furthermore, an opponent's legs have so much less mass than his torso that reaction forces resulting from a blow delivered at less than the optimal 90° angle will be minimal as well.

Figure 3:
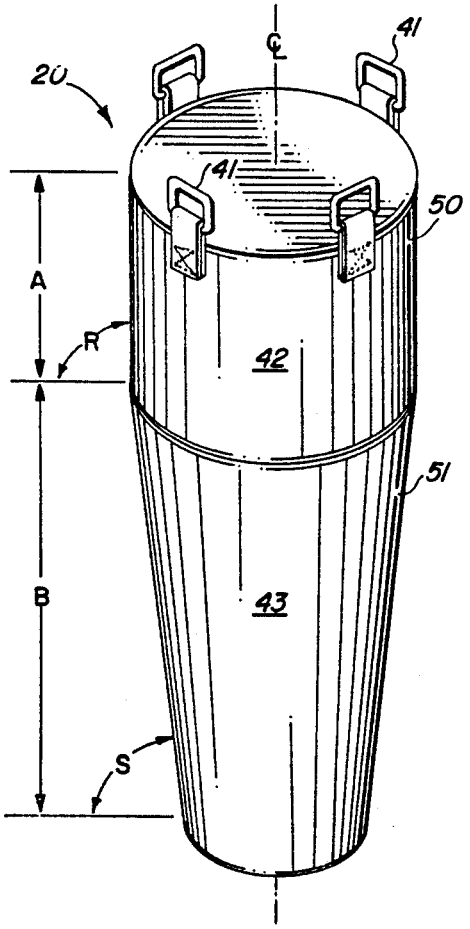
FIG. 3 illustrates a first embodiment of the invention having an upper cylindrical section and a lower, tapered, conical section.

In FIG. 3 is shown a new strike and kick bag 20 in accord with the teachings herein. Bag 20 has an upper section 42, which is cylindrical in shape; and a lower tapered section 43, which is conical in shape. The two sections 42 and 43 share a common axis or center line. Bag 20 will generally be suspended by means of suspension rings 41 such that the axis is vertical. Under these condition, the outer wall 50 of section 42 will generally be positioned at the height of the head and shoulders of a selected opponent. Outer wall 50 is, of course, generally parallel to the longitudinal axis of bag 20.

The lower section 43 is a truncated cone having it's base coupled to the upper section 42 in a non-abrupt transition, smoothly and linearly tapering into truncated cone section 43. It's outer wall 51 makes an angle S of approximately 70° with the horizon. Thus, outer walls 51 taper at an angle of 30° with respect to the axis of the bag. The reader is cautioned that the angular dimensions indicated here with respect to FIG. 3, and later with respect with FIG. 4, are set forth for purposes of exposition only and not of limitation.

The vertical wall 50 of upper section 42 effectively receives jabs and striking blows advanced within a plane perpendicular to the axis of bag 20. Wall 51, on the other hand, tapering down and inward toward the axis, serves its most effective purpose when receiving a rising hook punch or kick traveling at an angle inclined upwardly with respect to the axis. Such a blow, delivered along a rising incline, will much more closely approach an impact angle of 90° with wall 51 than would be possible if section 43 were cylindrical.

By controlling the height in which bag 20 is suspended, using suspension rings 41, the person practicing the martial arts may have a practice training bag representing opponents of various selected heights. The person practicing the art may concentrate on the delivery of blows traveling generally in a plane perpendicular to the axis of bag 20 or arriving at a rising inclined angle to that axis. Because the walls 50 and 51 of bag 20 are at selected angular dispositions with respect to the axis of bag 20, striking blows delivered to those respective sections can be expected to be most effective because they will strike the wall generally at impact angles of 90°.

Figure 4:
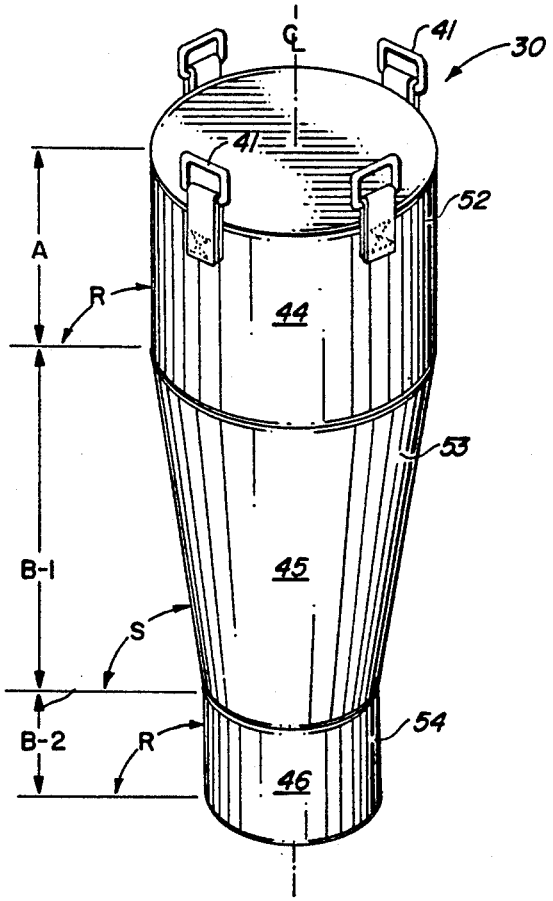
FIG. 4 is another embodiment of the invention wherein a third section, a cylindrical section, is coupled to the lower conical section of the bag of FIG. 3.

An alternate embodiment of the invention is presented in FIG. 4. In this embodiment, bag 30 is comprised of three sections. The upper section 44 is cylindrical in shape and has an outer wall 52 which is parallel to the axis or center line of bag 30. A central, tapering section 45 has an outer wall 53 tapering downward and inward toward the axis at an intersection angle of approximately 30°. A third and lowermost section 46 is cylindrical in shape and has an outer wall 54. Outer wall 54 is generally parallel to the axis of bag 30. The indicated angles R and S are as set forth in the discussion of FIG. 3.

With the three sections shown, and remembering the teachings with respect to FIG. 3, bag 30 may be effectively employed in the following manner. The upper section 44 will effectively receive jabs and striking blows delivered in a plane generally orthoginal to the axis of bag 30. The tapering central section 45 will be susceptible to the effective receipt of rising hook punches and kicks delivered along a rising incline with respect to the axis of bag 30. The lowermost, cylindrical section 46 has its wall 54 ideally angled with respect to the axis for the receipt of groin kicks and leg checks.

To acquaint the reader with dimensions which may be used to manufacture a typical strike and kick practice bag, the following dimension table is provided. Once again, however, the reader is cautioned that these dimensions are provided for exemplary purposes only and are not intended as limitations on the invention.

| Dimension | Inches |
|---|---|
| A | 16 |
| B | 26 |
| B-1 | 20 |
| B-2 | 12 |
| Circumference of Bag | |
| At Top | 48 |
| At Bottom | 34 |

In those instances where practice emphasis is to be placed on striking blows delivered to bag 20 in an upwardly directed angle only, dimension A may be reduced essentially to zero, with the tapering wall beginning at suspension rings 41.

As is clearly shown in FIG. 3, wall sections 50 and 51 form a continuous outer wall of bag 20, there being no spatial interruptions between cylindrical section 42 and conical section 43. So too, wall sections 52, 53, and 54 of bag 30 are shown in FIG. 4 to form a continuous outer wall with no spatial interruptions between or among cylindrical section 44, conical section, 45 and cylindrical section 46. Both FIGS. 3 and 4 show that suspension rings 41 are generally spaced equidistant about the upper cylindrical sections of the respective bags.

What has been disclosed is a martial arts kick and strike bag made up of cylindrical and conic sections. A cylindrical section will effectively receive blows delivered in a plane orthoginal to the axis of the practice bag. Blows delivered along a rising incline with respect to the axis of the bag will be most effectively received by the wall of the conic section. Blows are most effectively received when striking the wall of the bag at an impact angle of approximately 90°. The selected angles of the bag walls with respect to the axis of the bag minimize reaction forces such as might result from rising striking blows delivered to prior art, cylindrical, training bags.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, that which is claimed is:

1. A martial arts training bag suitable for striking by a person practicing a martial art, said bag comprising:

(a) a first upper, generally cylindrical section having a top surface and a bottom edge, said first upper section being generally representative of the head and shoulder region of an opponent's body;

(b) a second section coupled to the bottom edge of said first section in a non-abrupt transition, said second section having a generally conical surface configuration terminating at a lower edge, said second section being axially aligned with said first section, said second section tapering downwardly and inwardly at an angle of approximately 30° with respect to the axis of the bag and being generally representative of the torso region of an opponent whereby striking blows to said second section will generally be imparted at 90° with respect to the surface of the section;

(c) suspension means coupled to said bag for suspending the bag in a position to be struck;

(d) said second section having an axial length approximately at least one and one-half that of said first section; and (e) a third generally cylindrical section axially aligned with said first and second sections and being coupled to the lower edge of said second section in a non-abrupt transition, said third section being generally representative of the hip-to-knee region of an opponent, said third section having an axial length less than that of said first section.

2. The martial arts training bag of claim 1 wherein said suspension means comprises a plurality of rings equidistantly spaced about the top surface of said front section.

* * * * *